US006030473A

United States Patent [19]

Oberländer

[11] Patent Number: 6,030,473

[45] Date of Patent: Feb. 29, 2000

[54] METHOD FOR MANUFACTURING A GRANULAR MATERIAL FOR PRODUCING IGNITION NUCLEI IN PROPELLANTS AND FUELS

[75] Inventor: Irmtraud Oberländer, Buttenheim, Germany

[73] Assignee: IRT-Innovative Recycling Technologie GmbH, Werdau, Germany

[21] Appl. No.: 09/160,863

[22] Filed: Sep. 25, 1998

[30] Foreign Application Priority Data

Sep. 26, 1997 [DE] Germany ..... 197 42 489
Jun. 30, 1998 [DE] Germany ..... 198 29 175

[51] Int. Cl.[7] ..... D03D 23/00; C06B 21/00

[52] U.S. Cl. ..... 149/109.6; 264/3.4; 264/3.5; 264/3.6

[58] Field of Search ..... 149/109.6, 110, 149/111, 112, 113, 114, 115; 264/3.4, 3.5, 3.6

[56] References Cited

U.S. PATENT DOCUMENTS 4,723,993 2/1988 Kopatz et al. ..... 75/0.5 A
4,761,263 8/1988 Politis et al. ..... 419/33
5,565,710 10/1996 Ochi et al. ..... 264/3.4
5,660,773 8/1997 Stangle et al. ..... 264/6
5,660,774 8/1997 Stangle et al. ..... 505/425

*Primary Examiner*—Charles T. Jordan
*Assistant Examiner*—Aileen J. Baker
*Attorney, Agent, or Firm*—Herbert L. Lerner; Laurence A. Greenberg; Werner Stemer

[57] ABSTRACT

Surface reactors for propellants operate with a copper/tin alloy and convert unsaturated hydrocarbons at low concentration into tin organics that are extremely highly ignitable and therefore act as ignition nuclei in the combustion of propellants. However, it loses some of its effect when used to form ignition nuclei in propellants. This is improved by melting the granular material in an alloy made from tin with at least one solution-activating alloying constituent, and then quenching it in an oxidation-preventing medium of the granular material so as to produce a particle size of up to 3 mm diameter and a large surface area. The novel granular material has a substantially larger surface area than granular material previously used for this purpose. Its efficiency is thus higher than previously possible. The granular material is not subject to aging with regard to its action as a metallic reaction partner in propellants and fuels, as a result of which the efficiency of the granular material is wholly maintained during its entire lifetime.

27 Claims, No Drawings

METHOD FOR MANUFACTURING A GRANULAR MATERIAL FOR PRODUCING IGNITION NUCLEI IN PROPELLANTS AND FUELS

BACKGROUND OF THE INVENTION

Field of the Invention

The invention relates to a method for manufacturing a granular material for producing ignition nuclei in propellants and fuels.

Surface reactors which are denoted as "fuel finishers" are known. They operate with a copper-tin alloy and convert unsaturated hydrocarbons in the propellants or fuels at low concentration into tin organics which are extremely highly ignitable and therefore act as ignition nuclei in the combustion of propellants and fuels. In order to produce the ignition nuclei, the propellant or fuel is heated up, led through the surface reactors and fed after the reaction to an internal combustion engine or burner.

It is known to quench the copper-tin alloy from the melt onto a cooled band as granules, that is to say metal grains obtained by granulation. It is also known to free the solidified particles of their oxide layer in sodium hydroxide solution and subsequently store them in oil or gasoline, in order to avoid their renewed oxidation. Residues of sodium hydroxide solution, which favors the formation of a new oxide layer in the event of storage over several months, are responsible for the aging of the granular material. As a result, the granular material loses some of its effect when it is used to form ignition nuclei in propellants and fuels.

It is also known to produce granules by blowing liquid melt with various inert gases, such as nitrogen, argon, krypton, xenon, etc. The prior art processes are associated with a range of disadvantages which limit their use substantially.

SUMMARY OF THE INVENTION

It is accordingly an object of the invention to provide a method of manufacturing a granular material for producing ignition nuclei in propellants and fuels, which overcomes the above-mentioned disadvantages of the prior known devices and methods of this general type.

With the foregoing and other objects in view there is provided, in accordance with the invention, a method of manufacturing a granular material for producing ignition nuclei in propellants and fuels by treating the propellants or fuels with the granular material. The novel method comprises the following steps:

melting granular material in a tin alloy with at least one solution-activating alloying constituent, and quenching the granular material in the oxidation-preventing medium and thereby producing a granular material with a particle diameter of up to 3 mm and a large surface area.

In accordance with another feature of the invention, the granular material is cooled in an oxidation-preventing medium and granular material is produced with a particle diameter of up to 3 mm.

The invention has various advantages as compared with the prior art. The granular material manufactured with the new method has a substantially larger surface area than granular material previously used for this purpose. As a result, its efficiency is higher than has previously been possible. The granular material is not subject to aging with regard to its effect as a metallic reaction partner in propellants and fuels. The efficiency of the granular material is therefore wholly maintained during its entire lifetime.

The starting substances for the granular material need not be free from other alloying constituents.

The granular material presents no problems with reference to the environment, because it is a recyclable material which produces no poisonous substances and which therefore causes no environmental damage either during its manufacture or during its use.

The granular material is obtained in an alloy made from tin with at least one solution-activating alloying constituent.

EXAMPLE 1

In a first exemplary embodiment of the invention, the melt is produced for this purpose at a high temperature in a nonoxidizing atmosphere, quenched in a medium that prevents the oxidation of the granular material, and thereafter cooled down to the temperature of use or the ambient temperature.

EXAMPLE 2

In a second exemplary embodiment of the invention, the melt is produced at a high temperature in a non-oxidizing atmosphere, and, instead of being quenched, it is only cooled down in a medium preventing the oxidation of the granular material, and thereafter it is cooled down further to ambient temperature.

In both embodiments of the process, that is to say on the one hand with the process step of quenching the melt in an oxidation-preventing medium and, on the other hand with the step of cooling the melt in the medium preventing the oxidation of the granular material, the outlet for the melt is arranged so high above the oxidation-preventing material that the melt flow is (dis)integrated into particles in the form of drops. The droplets fall into the medium preventing the oxidation of the granular material and form particles there of between 10 $\mu$m and 3 mm.

The particles—in the form of drops or grains—that are quenched in the medium preventing the oxidation of the granular material have a substantially larger surface area than the particles in the form of drops and only cooled in the medium preventing the oxidation of the granular material.

In both cases, a granular material with the composition of the alloy is situated in the region of the eutectic point between tin and the solution-activating alloying constituent. The granular material remains continuously in the medium preventing its oxidation.

If, however, the granular material is not intended to remain in the medium preventing its oxidation, it is transferred from the medium in a likewise nonoxidizing medium to the relevant propellant or fuel.

In one exemplary embodiment of the invention, the alloy contains tin and copper, such as 92–98% tin and 8–2% copper.

In another exemplary embodiment of the invention, the alloy contains tin and silver, such as 96% tin and 4% silver.

In accordance with a further exemplary embodiment of the invention, the alloy contains tin and magnesium, such as 87–93% tin and 13–7% magnesium.

In one exemplary embodiment of the invention, the medium preventing the oxidation of the granular material is a propellant.

In a further exemplary embodiment of the invention, the medium preventing the oxidation of the granular material is a fuel.

A further exemplary embodiment of the invention provides that the medium preventing the oxidation of the granular material is oil.

In a further exemplary embodiment of the invention, the medium preventing the oxidation of the granular material is a thermal oil.

In another exemplary embodiment of the invention, the medium preventing the oxidation of the granular material is a diesel oil.

In a further exemplary embodiment of the invention, the medium preventing the oxidation of the granular material is heating oil.

A further exemplary embodiment of the invention provides that the medium preventing the oxidation of the granular material is hydraulic oil.

In a further exemplary embodiment of the invention, the medium preventing the oxidation of the granular material is gasoline.

In a further exemplary embodiment of the invention, a noble metal is added to the melt as additive.

In another exemplary embodiment of the invention, titanium is added to the melt as additive.

A further exemplary embodiment of the invention provides that silver is added to the melt as additive.

According to another exemplary embodiment of the invention calcium is added to the melt as additive.

In accordance with a further exemplary embodiment of the invention cobalt is added to the melt as additive.

A further exemplary embodiment of the invention provides that molybdenum is added to the melt as additive.

According to another exemplary embodiment of the invention, magnesium is added to the melt as additive.

A further exemplary embodiment of the invention provides that manganese is added to the melt as additive.

In accordance with another exemplary embodiment of the invention, lithium is added to the melt as additive.

As alloy components, the above-named additives enhance the activity and long-term stability of the granular material.

Although the invention is illustrated and described herein as a method of producing granulate material for producing ignition nuclei in propulsion materials and fuels, it is nevertheless not intended to be limited to the details shown, since various modifications and structural changes may be made therein without departing from the spirit of the invention and within the scope and range of equivalents of the following claims.

While the operation of the invention, together with additional objects and advantages thereof will be best understood from the embodiments and examples described above, it is not limited to those, but the invention is defined in the following claims.

I claim:

1. A method of manufacturing a granular material for producing ignition nuclei in propellants and fuels by treating the propellants or fuels with the granular material, the method which comprises:

forming granular material in a tin alloy melt with at least one solution-activating alloying constituent; and quenching the granular material in an oxidation-preventing medium and thereby producing a granular material with a particle diameter of up to 3 mm and a large surface area.

2. The method according to claim 1, which further comprises subsequently storing, transporting, and using the granular material in the oxidation-preventing medium.

3. The method according to claim 1, which further comprises transferring the granular material from the oxidation-preventing medium into a propellant or fuel while excluding air.

4. The method according to claim 1, wherein the alloy contains pairs of alloying materials selected from the group consisting of tin and copper, tin and silver, and tin and magnesium.

5. The method according to claim 4, wherein the alloy contains 92–98% tin and 8–2% copper.

6. The method according to claim 4, wherein the alloy contains 96% tin and 4% silver.

7. The method according to claim 4, wherein the alloy contains 87–93% tin and 13–7% magnesium.

8. The method according to claim 1, wherein the oxidation-preventing medium is a propellant.

9. The method according to claim 1, wherein the oxidation-preventing medium is a fuel.

10. The method according to claim 1, wherein the oxidation-preventing medium is an oil.

11. The method according to claim 10, wherein the oxidation-preventing medium is an oil selected from the group consisting of thermal oil, diesel oil, heating oil, and hydraulic oil.

12. The method according to claim 1, wherein the oxidation-preventing medium is gasoline.

13. The method according to claim 1, which comprises adding a material selected from the group consisting of noble metal, titanium, silver, calcium, cobalt, molybdenum, magnesium, manganese, and lithium, to the melt as additive.

14. A method of manufacturing a granular material for producing ignition nuclei in propellants and fuels by treating the propellants or fuels with the granular material, the method which comprises:

forming granular material in a tin alloy melt with at least one solution-activating alloying constituent; and cooling the granular material in a medium preventing the oxidation thereof and producing granular material with a particle diameter of up to 3 mm.

15. The method according to claim 14, wherein the cooling step comprises quenching the granular material in the oxidation-preventing medium and thereby producing a granular material with a particle diameter of up to 3 mm and a large surface area.

16. The method according to claim 14, which further comprises subsequently storing, transporting, and using the granular material in the oxidation-preventing medium.

17. The method according to claim 14, which further comprises transferring the granular material from the oxidation-preventing medium into a propellant or fuel while excluding air.

18. The method according to claim 14, wherein the alloy contains pairs of alloying materials selected from the group consisting of tin and copper, tin and silver, and tin and magnesium.

19. The method according to claim 18, wherein the alloy contains 92–98% tin and 8–2% copper.

20. The method according to claim 18, wherein the alloy contains 96% tin and 4% silver.

21. The method according to claim 18, wherein the alloy contains 87–93% tin and 13–7% magnesium.

22. The method according to claim 14, wherein the oxidation-preventing medium is a propellant.

23. The method according to claim 14, wherein the oxidation-preventing medium is a fuel.

24. The method according to claim 14, wherein the oxidation-preventing medium is an oil.

25. The method according to claim 14, wherein the oxidation-preventing medium is an oil selected from the group consisting of thermal oil, diesel oil, heating oil, and hydraulic oil.

26. The method according to claim 14, wherein the oxidation-preventing medium is gasoline.

27. The method according to claim 14, which comprises adding a material selected from the group consisting of noble metal, titanium, silver, calcium, cobalt, molybdenum, magnesium, manganese, and lithium, to the melt as additive.

* * * * *